United States Patent [19]

Bennett

[11] 4,183,316

[45] Jan. 15, 1980

[54] VARIABLE VOLUME DEPTH CONTROL

[75] Inventor: George J. Bennett, El Cajon, Calif.

[73] Assignee: The United States of America as represented by the Secretary of the Navy, Washington, D.C.

[21] Appl. No.: 857,720

[22] Filed: Dec. 5, 1977

[51] Int. Cl.[2] ..... B63B 39/04; B63B 43/06

[52] U.S. Cl. ..... 114/331; 114/125; 114/53; 9/8 R

[58] Field of Search ..... 114/121, 125, 331, 333, 114/52, 53, 54; 9/8 R, 8.3 R, 8.3 E, 9, 11 A

[56] References Cited

U.S. PATENT DOCUMENTS

| | | | |
|---|---|---|---|
| 2,413,985 | 1/1947 | Manson | 9/11 A |
| 3,520,263 | 7/1970 | Berry | 114/331 |
| 3,631,551 | 1/1972 | Miller | 114/331 |
| 3,665,883 | 5/1972 | Sege | 114/331 |
| 3,680,160 | 8/1972 | Heikki | 9/8 R |
| 3,753,311 | 8/1973 | Boone | 9/8 R |

*Primary Examiner*—Edward R. Kazenske
*Assistant Examiner*—D. W. Keen
*Attorney, Agent, or Firm*—Richard S. Sciascia; Ervin F. Johnston; James O. Skarsten

[57] ABSTRACT

An apparatus for controlling the depth of an object submerged in a liquid medium includes a sealed chamber means, joined to the object, which retains a working fluid and which has a variable external volume for displacing variable amounts of the medium. The apparatus further includes a heat transfer device for controlling the external volume of the chamber by heating the working fluid to increase the external volume, and by cooling the working fluid to decrease the external volume.

9 Claims, 5 Drawing Figures

26
12
14
26
16
10
20
18
22
24

VARIABLE VOLUME DEPTH CONTROL

STATEMENT OF GOVERNMENT INTEREST

The invention described herein may be manufactured and used by or for the Government of the United States of America for governmental purpose without the payment of any royalites thereon or therefor.

BACKGROUND OF THE INVENTION

The invention pertains to a control for regulating the level or depth of an object in a liquid medium by means of an expandable working fluid. More particularly, the invention pertains to a control for regulating depth by heating and cooling a working fluid which is kept separated from the liquid medium by means of a displaceable barrier.

In the past, control of the operating depth of an underwater object, and the ascensions and descensions thereof, has usually required a system which changes the weight of the object, either by dropping ballast or by pumping water in and out. A ballast system requires storage of bulky and exhaustible weight. A system employing mechanical pumps requires a multiplicity of moving parts, producing reliability, and may be too noisy for certain military applications.

To overcome some of these disadvantages, some systems have been developed which include a chamber having ports or openings in the lower portion thereof, and a container for storing gas which is lighter than water under pressure. Upon launching such a system into a body of seawater or the like, seawater completely fills the chamber, causing the system to descend. To hydrodynamically stabilize the system at a selected depth, or to cause the system to ascend, the gas is released from the container into the chamber. The expansion of the gas forces some or all of the water out of the chamber through the ports, reducing the weight of the system.

A disadvantage of such a system lies in the possibility of a sudden reversal in the vertical orientation of the chamber, which would result in the escape of the gas through the ports, and a consequent flooding of the chamber. Also, the gas used in such a system is limited to a gas which is non-soluable in water, and once released from its container, the gas may not be recovered for reuse unless the system includes fairly elaborate gas compression or refrigeration equipment.

SUMMARY OF THE INVENTION

The present invention discloses an apparatus for controlling the depth of an object submerged in a liquid medium and includes a sealed chamber means adapted to be joined to the object for retaining a working fluid, the chamber means having a variable external volume which displaces varying amounts of the medium. The apparatus further includes heat transfer means for controlling the external volume of the chamber means by heating the working fluid to increase the external volume, and by cooling the working fluid to decrease external volume. The chamber means may include a chamber formed of rigid material, there being an aperture through the chamber which is sealed by means of a flexible diaphragm which is joined to the chamber across the aperture. The diaphragm is urged outwardly from the interior of the chamber means when the working fluid is heated and is urged inwardly toward the interior of the chamber means when the working fluid is cooled. It may be noted that an object employing an embodiment of the invention herein disclosed may make repeated ascensions and descensions by the selective heating and cooling of the working fluid.

Preferably, the heat transfer means comprises a means for heating working fluid and a means for cooling working fluid. In a useful embodiment, the heating means comprises a heating element and a battery of selected capacity, and the cooling means comprises a means for continually drawing heat from the working fluid. Such an embodiment could be usefully employed with an object comprising military equipment which is to be deployed in a body of water at a selected depth for a specified period of time, and which is thereafter to be sunk to prevent recovery by an unfriendly force. The apparatus would maintain the object at the selected depth for a time duration determined by the capacity of the battery. When the battery was exhausted no further heat could be provided to heat the working fluid, and the object would sink due to the continual flow of heat through the cooling means.

It is by no means intended, however, to limit the scope of the invention herein disclosed to any such embodiment or to any such application. For example, in another embodiment the invention could provide means for selectively interrupting both the operation of the heating means and the cooling means.

OBJECTS OF THE INVENTION

An object of the invention herein disclosed and claimed is to control the depth of an object in a liquid medium by expanding and contracting a working fluid which is kept separated from the liquid medium by means of a displaceable barrier.

Another object is to provide an apparatus for controlling the depth of an object in liquid medium which minimizes the moving mechanical components necessary therefor.

Another object is to provide an apparatus for controlling the depth of an object in a liquid medium which does not require storage space for ballast or for a container storing gas under pressure.

These and other objects of the invention will become more readily apparent from the ensuing specification when taken together with the drawings.

DESCRIPTION OF THE PREFERRED EMBODIMENTS

Figure 1:
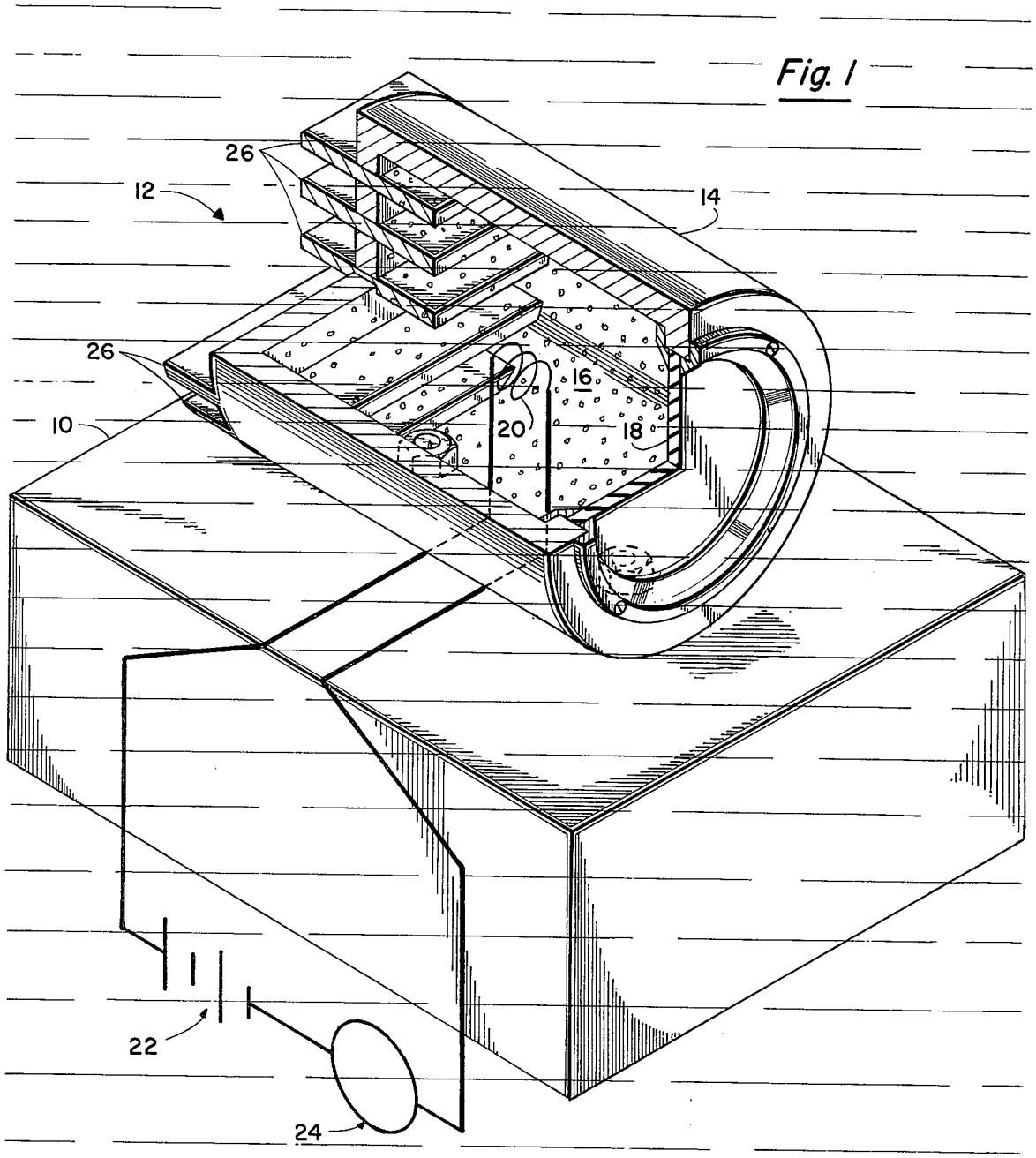
FIG. 1 is a perspective view having a section cut away which shows an embodiment of the invention.

Referring to FIG. 1, there is shown an object which has a negative buoyancy in a liquid medium such as an ocean body and which is to be submerged in the liquid medium to a depth D. Depth control 12 is joined to object 10 to maintain object 10 in hydrostati- equilibrium at depth D, or within a selected range centered therearound.

Control 12 includes a chamber 14 for enclosing a working fluid 16, fluid 16 being a fluid which is expandable when it is heated and contractable when it is cooled. Working fluid 16 comprises a gaseous fluid such as nitrogen or a noble gas such as argon. Chamber 14 is formed from a rigid material such as steel, and an aperture through chamber 14 is sealed by a displaceable barrier, such as a flexible, nonresiliant diaphragm 18 joined to chamber 14, diaphragm 18 being formed from material such as mylar. Chamber 14 and diaphragm 18 together comprises a sealed chamber means which retains fluid 16, preventing fluid 16 from being dissipated into the liquid medium, regardless of the orientation of the chamber means with respect to the surface of medium 12. Control 12 further includes an electric heating element 20, which is energized by a battery 22 located aboard or attached to object 10, and which heats working fluid 16 when object 10 has descended below depth D. Upon being heated, fluid 16 expands, and diaphragm 18 is urged outwardly from the interior of the chamber means. The external volume of the chamber means, which is the volume included within all of the surfaces of chamber 14 and diaphragm 18 which are in contact with the liquid medium, thereupon increases, displacing an amount of liquid medium. In accordance with Archimede's principal, an upward force is thereby imparted to control 12 and object 10 which is equal to the weight of the displaced amount of medium. The upward force increases as the chamber means expands, causing object 10 to ascend, until it reaches depth D. Thereupon, depth control switch 24, coupled between heating element 20 and battery 22, disconnects element 20 from battery 22 so that there is no further increase of the volume of the chamber means, or of the upward force resulting therefrom. By providing depth control switch 24, expansion of the volume of the chamber means is limited to the expansion required to maintain object 10 in hydrodynamic stability at depth D. Depth control switch 24 may comprise, for example, a combination of an electrical switch and a standard depth gage which is set to close the electrical switch only when object 10 is sensed to be below depth D.

To cause object 10 to descend from a level above depth D, control 12 is provided with cooling fins 26, which traverse a wall of chamber 14 and are therefore in contact with both the medium and fluid 16. Fins 26 are formed from selected heat conductive material, and control 14 is designed in consideration of the ambient temperature of the liquid medium, so that heat continually flows from fluid 16 to the liquid medium. Fins 26 are structured so that the heat per unit time withdrawn from fluid 16 through fins 26 and through the walls of chamber 14 is less than the heat per unit time provided thereto by heating element 20, when element 20 is energized. However, when heating element 20 is not energized, fluid 16 loses heat and contracts, whereupon the pressure of the medium urges diaphragm 18 inwardly towards the interior of the chamber means, decreasing the external volume of the chamber means. The amount of liquid medium displaced by the chamber means is thereupon decreased, and the upward force on object 10 is reduced, whereby object 10 descends until it reaches depth D. At depth D, depth control switch 24 operates to connect heating element 20 and battery 22, halting further contraction of the chamber means.

It will be readily apparent that movement of diaphragm 18 is the only mechanical motion in the operation of depth control 12. Consequently, the noise generated thereby is minimized and the reliablity thereof is improved over other depth control systems which require a multiplicity of moving parts.

It will be further apparent that the amount of displacement of diaphragm 18 which is required to stabilize object 10 at depth D will be minimized if object 10 and control 12 are respectively designed so that the body comprising the union thereof is very close to neutral buoyancy at depth D.

Figure 2:
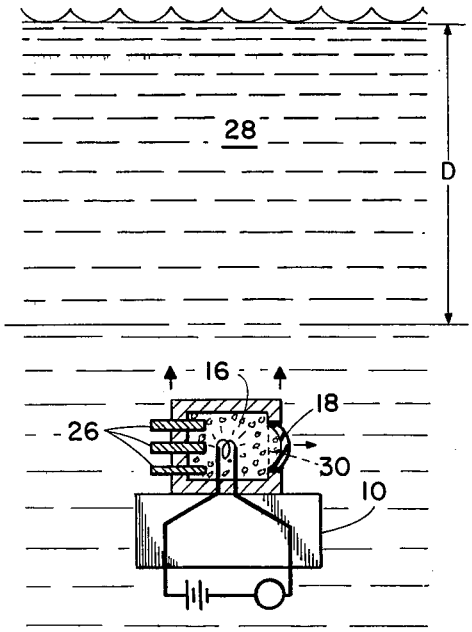
FIGS. 2 and 3 are cross-sectional views showing the embodiment of FIG. 1 submerged in a liquid medium.

Referring to FIG. 2, there is shown object 10 and control 12 submerged in a liquid medium 28 at a depth below depth D, heating element 20 being energized to heat fluid 16 and to urge diaphragm 18 outwardly from its displacement when object 10 is at depth D. Dotted line 30 represents the displacement of diaphragm 18 when object 10 is at depth D. As diaphragm 18 expands outwardly, an upward force is applied to object 10, as hereinbefore described, causing object 10 to ascend toward depth D.

Figure 3:
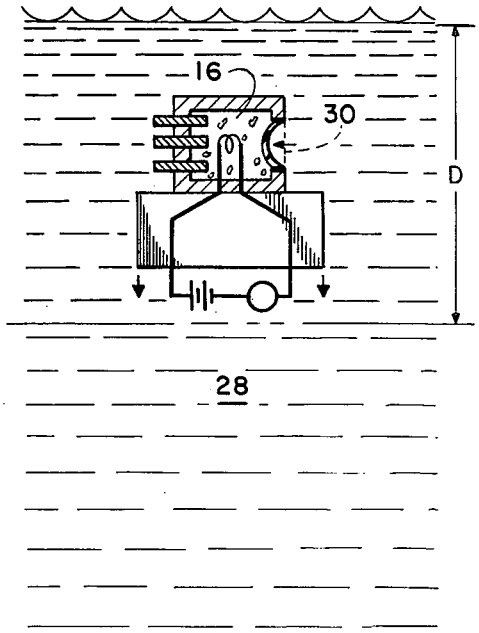

Referring to FIG. 3, there is shown object 10 and control 12 submerged in liquid medium 28 to a depth above depth D, heating element 20 being de-energized to cool working fluid 18. Diaphragm 18 is urged inwardly from its displacement when object 10 is at depth D, represented by dotted line 30. As diaphragm 18 contracts inwardly, a downward force is applied to object 10, as hereinbefore described causing object 10 to descend toward depth D.

Figure 4:
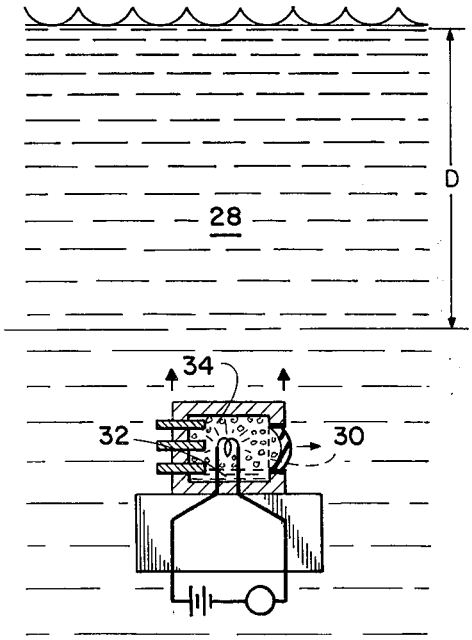
FIGS. 4 and 5 are cross-sectional views showing a modification of the embodiment of FIG. 1, the embodiment shown in FIGS. 4 and 5 being the same as the embodiment shown in FIG. 1 except that a two state working fluid has been substituted for the gaseous working fluid of FIG. 1.

Referring to FIG. 4, there is shown object 10 and control 12 submerged in liquid medium 28 to a depth below depth D, control 12 comprising all of the elements shown in FIGS. 1–3 except that instead of gaseous fluid 16, a two-state working fluid is employed which has a liquid component 32 and a gaseous component 34. The working fluid could comprise a single fluid which is maintained partially in a liquid state and partially in a gaseous state while object 10 is submerged. When element 20 is energized to raise object 10, the gaseous component 34 of the fluid increases and liquid component 32 thereof decreases. A two-state fluid of this type could comprise water or freon, and may provide greater efficiency in the operation of control 12 than a working fluid having only a gaseous state, where efficiency is defined as being the ratio of work done to move diaphragm 18 to the heat provided by heating element 20.

Figure 5:
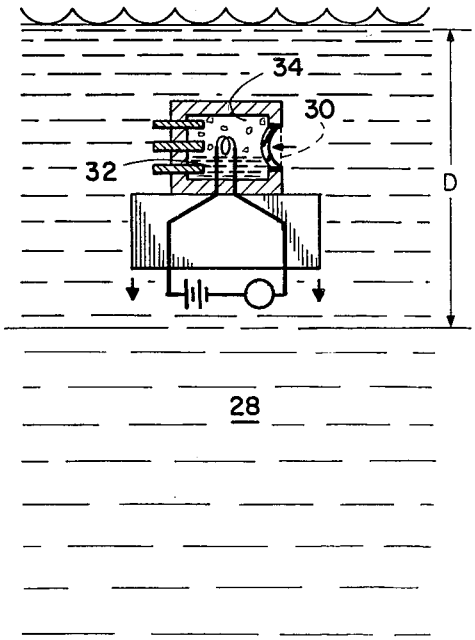

Referring to FIG. 5, there is shown object 10 above depth D so that element 20 is de-energized. The working fluid therefore cools, an increasing amount of the fluid going from a gaseous state to a liquid state, whereby liquid component 32 increases and gaseous component 34 decreases, diaphragm 18 being urged inwardly.

As an alternative to a single fluid having two states, the working fluid shown in FIGS. 4 and 5 could comprise a mixture of two fluids having different boiling points, one fluid being partially dissolved in the other. For example, liquid component 32 could comprise water, and gaseous component 34 could comprise ammonia, the amount of ammonia dissolved in the water decreasing when heating element 20 is energized, and increasing when element 20 is deenergized.

While the embodiments shown in FIGS. 1–5 employ a displaceable barrier comprising a flexible diaphragm for increasing and decreasing the volume of the chamber means, in a modification of the invention a piston adapted to move inwardly and outwardly through the aperture in chamber 14 could be employed therefor.

In another modification, the invention could be employed as a control for selectively raising and lowering an object 10 in a liquid medium as required. Repeated descensions and ascensions therein could be made by selectively heating and cooling the working fluid, the only limitation being the capacity of the battery or other power source used to heat the working fluid.

Obviously, many other modifications and variations of the present invention are possible in the light of the above teachings, and, it is therefore understood that within the scope of the disclosed inventive concept, the invention may be practiced otherwise than specifically described.

What is claimed is:

1. Apparatus for controlling the depth of an object submerged in a liquid medium, said apparatus comprising:

chamber means adapted to be joined to said object for retaining a working fluid, there being an aperture through said chamber means which is sealed by a flexible diaphragm which is in contact with said medium when said chamber means is submerged in said medium;

heat transfer means for increasing the buoyancy of said apparatus by heating said working fluid to urge said flexible diaphragm outwardly from the interior of said chamber means, and for decreasing the buoyancy of said apparatus by cooling said working fluid to urge said flexible diaphragm inwardly toward the interior of said chamber means.

2. The apparatus of claim 1 wherein:

said heat transfer means comprises a means for heating said working fluid, and a means for cooling said working fluid.

3. The apparatus of claim 2 wherein:

said heating means includes an electric heating element in contact with said working fluid, and said cooling means includes a plurality of cooling fins in contact with said working fluid.

4. The apparatus of claim 1 wherein:

working fluid retained by said chamber means comprises a gaseous fluid.

5. The apparatus of claim 1 wherein:

working fluid retained by said chamber means comprises a single fluid which is maintained partially in a liquid state and partially in a gaseous state while said object is submerged, the amount of said fluid in a gaseous state being increased to increase the external volume of said chamber means, and the amount of said fluid in a gaseous state being decreased to decrease the external volume of said chamber means.

6. The apparatus of claim 1 wherein:

working fluid retained by said chamber means comprises a mixture of a first and a second fluid, said first and second fluids having different boiling points, said first fluid being in a liquid state while said object is submerged, and varying amounts of said second fluid being dissolved in said first fluid.

7. Apparatus for controlling the depth of an object submerged in a liquid medium, said apparatus comprising:

a sealed chamber formed from rigid material for providing an enclosure, said chamber being attached to said object, and there being an aperture through said chamber;

working fluid contained in said enclosure;

a flexible, nonresilient diaphragm sealing said aperture for moving outward from said enclosure to increase the external volume of said chamber, and for moving inward toward said enclosure to decrease the external volume of said chamber, movement of said diaphragm comprising the only mechanical motion of said apparatus;

a plurality of cooling fins traversing said chamber for continually withdrawing heat from said working fluid during the operation of the apparatus and;

a heating element coupled to a battery through a depth control switch for heating said working fluid only when said object is below a selected depth in said liquid medium.

8. The apparatus of claim 7 wherein:

said working fluid comprises argon.

9. The apparatus of claim 7 wherein:

said working fluid comprises a mixture of ammonia and water.

* * * * *